United States Patent [19]

God, Jr.

[11] 4,124,197

[45] Nov. 7, 1978

[54] SAFETY TRAFFIC BARRIER

[76] Inventor: Andrew God, Jr., 9214 Kilmarnock Dr., Fairfax, Va. 22030

[21] Appl. No.: 858,205

[22] Filed: Dec. 7, 1977

[51] Int. Cl.[2] ..... E01F 9/01

[52] U.S. Cl. ..... 256/13.1; 40/612; 116/63 P; 52/2

[58] Field of Search ..... 40/584, 598, 606, 608, 40/612; 116/63 P; 248/160; 267/140; 256/1, 13.1, 64, DIG. 3, DIG. 4; 340/84, 87, 114 R, 114 B, 119; 404/9, 10; 52/2; 362/458, 431, 382

[56] References Cited

U.S. PATENT DOCUMENTS

| | | | |
|---|---|---|---|
| 2,561,016 | 7/1951 | Ford et al. | 362/812 |
| 2,762,327 | 9/1956 | Weig | 52/2 |
| 3,197,628 | 7/1965 | Schuff | 116/63 P |
| 3,526,199 | 9/1970 | Keats | 52/2 |
| 3,800,735 | 4/1974 | Simpson | 52/2 |

*Primary Examiner*—Werner H. Schroeder
*Assistant Examiner*—C. J. Arbes
*Attorney, Agent, or Firm*—Edmund M. Jaskiewicz

[57] ABSTRACT

A portable safety traffic barrier comprises a vertical hollow column of a thin flexible material upstanding from a base and a pair of vertically spaced substantially parallel hollow members of a resilient flexible material extending horizontally from the vertical column. Each of the column and horizontal members are inflated with a gaseous medium or are filled with a resilient medium so that the column and horizontal members will return to their initial positions after any impact thereto. The free ends of the arms are connected by a web and there is a light on one of the horizontal members connected through electrical leads to a battery mounted on the base. The leads are passed through loops on the column and horizontal member to secure the leads in position.

10 Claims, 5 Drawing Figures

SAFETY TRAFFIC BARRIER

The present invention relates to a portable safety barrier or marker for vehicular and pedestrian traffic, more particularly, to an inflatable barrier which will readily return to its initial position after an impact and which will not present any danger to automobiles or pedestrians.

Various forms of markers or barrier have been used to indicate dangerous areas in or adjacent to highways or sidewalks. Such barriers are many times positioned along side the edge of a road during construction or to indicate a excavation or some other potentially dangerous area such as might be encountered during road constructions or repairs. Barriers are also been employed to be positioned on roads so as to indicate to oncoming traffic that the detour should be made around the area marked off by the barrier. In a similar manner, holes or other dangerous areas on sidewalks have been marked off with barriers or markers so as to indicate to pedestrians that such areas should be avoided. In order to enhance their visibility, such barriers are generally provided with reflectors, lights or reflecting areas.

A commonly used form of such a barrier is constructed of wood or metal and has a relatively light structure. However, such barriers represent a solid obstacle in the event they are hit by a vehicle. In most instances not only is the barrier damaged or even destroyed but damage may result to the vehicle. Further, when such a barrier has been knocked down or otherwise damaged by a vehicle there is no longer any barrier or marker to indicate the danger area and subsequent traffic proceeding in the same area may not be able to avoid the dangerous area. Thus, considerable expense is encountered not only in replacing the barriers so damaged but in the necessity for providing personnel to continuously examine, repair and possible replace the barriers. The absence of a barrier from a dangerous area, even for a short period of time, may create an extremely dangerous situation which may result in injury to persons and/or damage to vehicles.

It is therefore the principal object of the present invention to provide a novel and improved safety barrier for vehicular and pedestrian traffic.

It is another object of the present invention to provide such a safety traffic barrier which is portable and which will automatically return to its initial position upon being subjected to an impact.

It is a further object of the present invention to provide such a safety traffic barrier which has high visibility but presents a minimum of danger to any persons or vehicles who may unintentionally come in contact with the barrier.

It is an additional object of the present invention to provide such a safety traffic barrier which is simple in construction, inexpensive to manufacture and install and which is reliable in operation.

According to one aspect of the present invention a portable safety traffic barrier may comprise a substantially vertical hollow column of thin flexible material upstanding from a relatively heavy base. A pair of vertically spaced substantially parallel hollow members of a thin flexible material extend horizontally from the column and both the column and horizontal members are filled with a resilient medium such that the column and horizontal members will return to their initial positions after any impact thereto. The free ends of the horizontal members are interconnected and there is a light on one of the horizontal members. A source of electrical energy is mounted on the base and has electrical leads extending to the lamp which leads are secured to the column and a horizontal member.

The ends of the horizontal members may be interconnected by a second vertical column also upstanding from the base.

The barrier may also comprise a single vertical column or pylon upstanding from the base and provided with a light or reflector.

Other objects and advantages of the present invention will be apparent upon reference to the accompanying description when taken in conjunction with the following drawings, which are exemplary, wherein:

FIG. 1 is a perspective view of a portable safety traffic barrier according to the present invention;

FIG. 1*a* is a sectional view taken along the line I—I of FIG. 1;

Proceeding next to the drawings wherein like reference symbols indicate the same parts throughout the various views a specific embodiment and modifications of the present invention will be described in detail.

Figure 1:
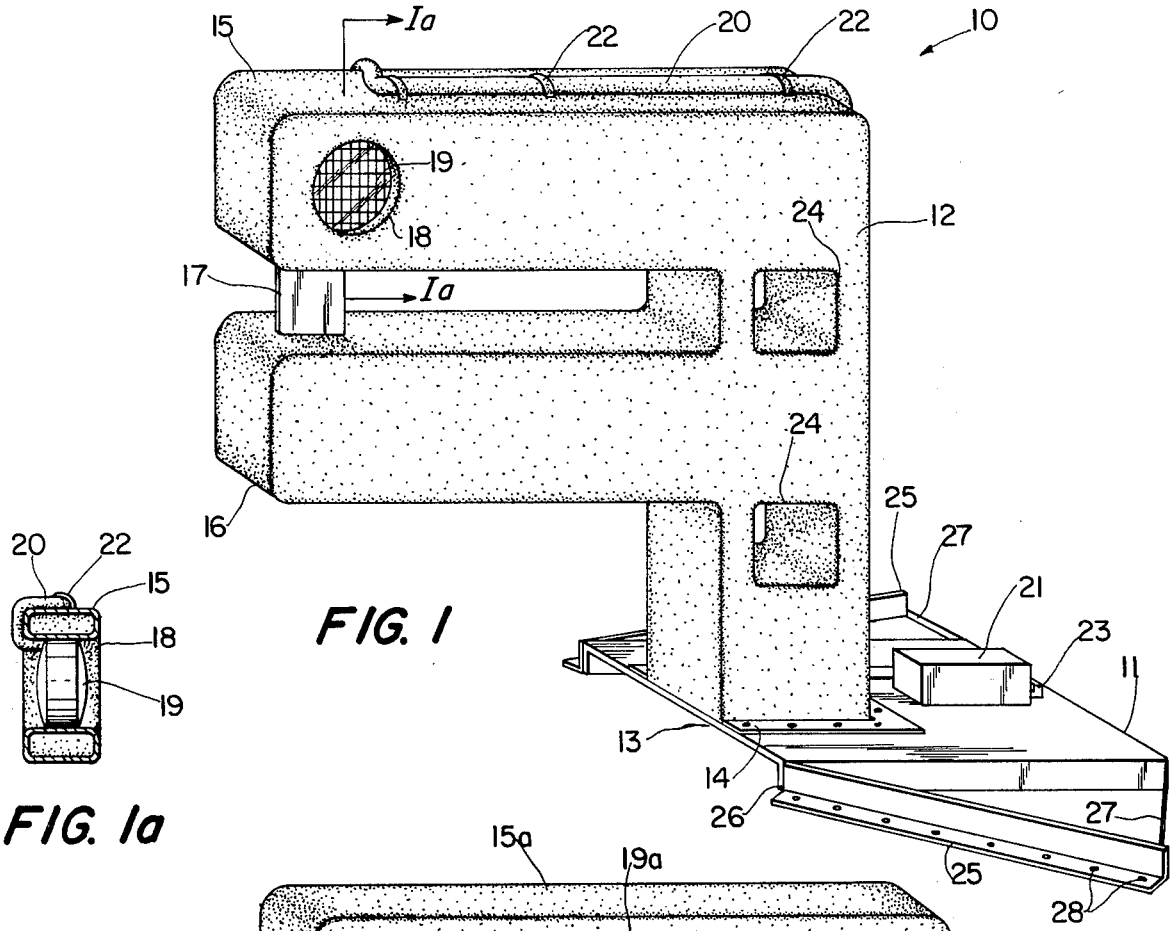

In FIG. 1, there is indicated generally at 10, a portable safety traffic barrier according to the present invention and comprising a base 11 having a channel-shaped cross-section as illustrated and being constructed preferably of a one-quarter inch thick heavy plastic material. The base and other components of the barrier as will be presently described are all formed from a poly vinyl chloride plastic material or of any other synthetic plastic material which is non-corrosive in nature. The base may also comprise a steel channel-shaped member which is embedded or coated in a suitable plastic. The base 11 is relatively heavy so as to provide a stable support for the barrier.

Figure 1A:
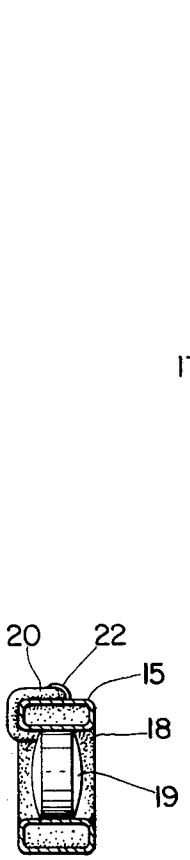

Upstanding from the base is a vertical hollow column of a thin flexible material such as poly vinyl chloride and the lower end of the column is attached to the base by a bracket 13 which in turn is attached by detachable snap fasteners or the like 14 to the base 11. The hollow 12 has substantially a rectangular cross-section as indicated in FIG. 1*a*.

Extending horizontally from one side of the column 12 are horizontal members 15 and 16 which are similarly hollow and made from a thin flexible material such as poly vinyl chloride. The cross-section of the horizontal members 15 and 16 is also substantially rectangular as shown in FIG. 1*a*. A web 17 interconnects the outer or free ends of the members 15 and 16. The upper member 15 is formed with an opening 18 therethrough in which is positioned a light or flashing lighted reflector which is connected by electrical leads 20 to a battery 21 mounted on the base 11. The leads 20 pass through loops 22 which are attached to the outer surfaces of the column 12 and horizontal member 15 as shown in order to secure the leads in position. An additional weight 23 which may be in the form of a block of concrete or some similar material of a high density may also be mounted on the top of the base 11 to assist in weighting down the base and thus stabilizing the barrier. Openings 24 are formed in the column 12 in order to decrease the wind resistance of the barrier.

Figure 2:
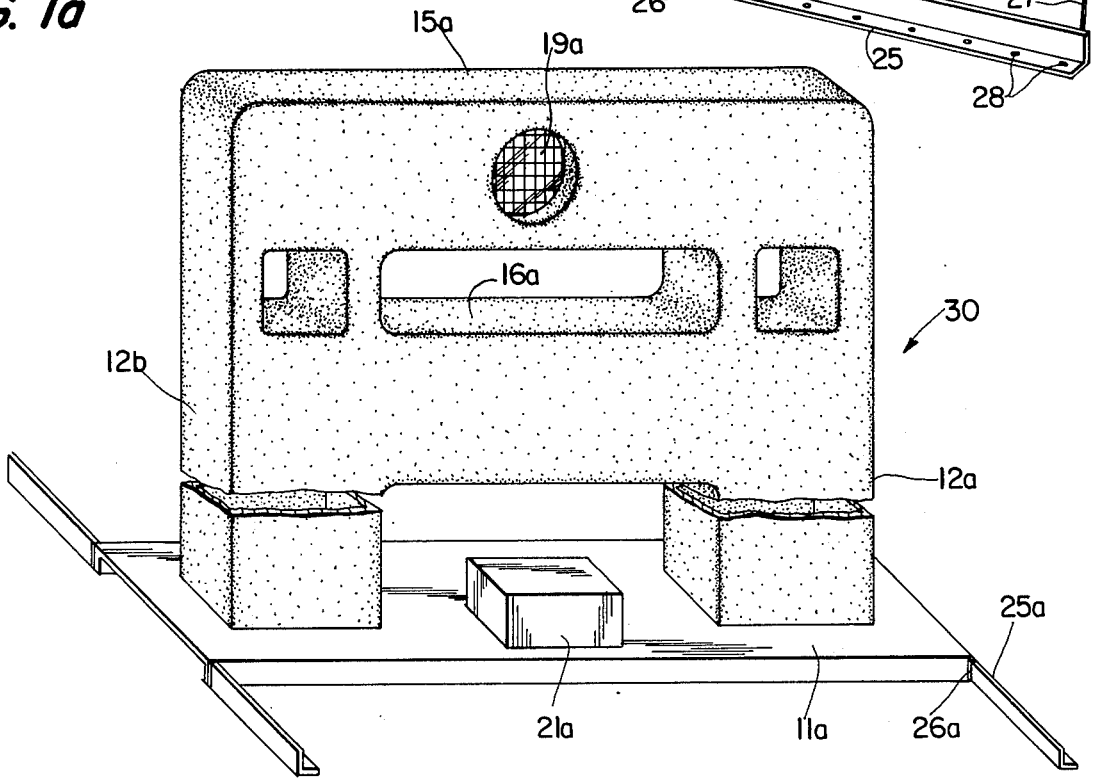
FIG. 2 is an overall perspective view of a modification wherein the barrier has two vertical columns.

To assist in stabilizing and securing the barrier in position a pair of stabilizing arms 25 are each pivoted at 26 to be pivotable outwardly into the position as shown in FIG. 2. A strut or strap 27 may be provided to limit the outward pivotal movement of the arms 25. Each arm 25 has the shape of an angle iron and a plurality of openings 28 may be formed in the bottom flange as shown in FIG. 2 so that the barrier may be secured to the pavement or ground through suitable fasteners passed through these openings.

The column 12 and the horizontal members 15 and 16 are connected to each other as described above but are separate from each other and each of these components is inflated with air or a suitable gaseous medium. The barrier thus comprises three inflatable sections and should any one section be ruptured or punctured in any manner the remaining inflated sections would support the structure. The damaged section could be easily repaired with a vinyl patch and then reinflated.

The stabilizer arms 25 are similarly formed of a plastic and can be easily folded against the base so that when the column and horizontal members are deflated the entire barrier can be readily folded into a small package which can be easily stored and transported.

The barrier of FIG. 1 is particularly intended, although not limited, to being positioned along the edge of a highway or road such that the horizontal arms 15 and 16 project out into the road way a distance of about three feet. This configuration permits a safety zone of about three feet from the critical edge of the pavement or highway. In the event a vehicle were to bump into the horizontal arms the vehicle would then have a three foot safety zone before being subjected to any danger. Any impact of the arms by a vehicle would merely temporarily deform the barrier and the components of the barrier would readily return to their initial positions, as illustrated in FIG. 1 after impact. Further, the resilient nature of the barrier would not damage in any way the vehicle.

In FIG. 2 there is shown a barrier indicated generally at 30 which is particularly intended as of the head-on warning barricade type so as to indicate no further travel beyond the barrier. This barrier comprises a pair of spaced vertical columns 12*a* and 12*b* between which the horizontal members 15*a* and 16*a* are connected. A battery 21*a* is positioned on base 11*a* between the columns and in a similar manner stabilizing arms 25*a* are pivotally connected to the corners of the base 11*a*. The light 19*a* is provided in the center of the upper horizontal member 15*a* and is connected by suitable leads to the battery as described above.

The barrier 30 thus comprises four inflatable sections two of which are vertical and two horizontal. In a similar manner, if any one section should rupture or tear so as to be deflated, the barrier would be supported in position by the remaining inflated sections.

Figure 3:
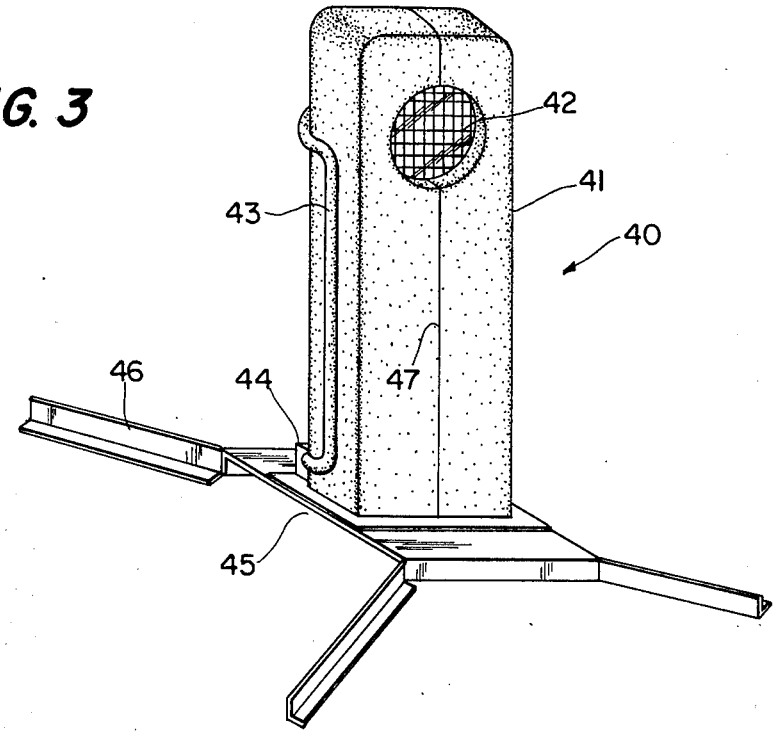
FIG. 3 is a perspective view of a further modification wherein the barrier comprises a single column or pylon.

In FIG. 3, there is shown a barrier 40 which comprises a single vertical column or pylon 41 which is similar to the above-described vertical columns 12, 12*a* and 12*b*. The column is provided with a light 42 connected by electrical leads 43 to a battery 44 mounted on a base 45 similar in construction to the base 11. Similarly, the base 45 is provided with stabilizing arms 46 pivotally connected by suitable hinges to the corners of the base. The column 41 may be provided with openings similar to those shown at 24 in FIG. 1 but in view of the relatively small frontal area of this pylon the barrier 40 can be constructed without the openings.

The pylon 41 is preferablt constructed of two separate sections interconnected along the seam 47 such that if one section should rupture the other section would support the barrier structure.

Figure 4:
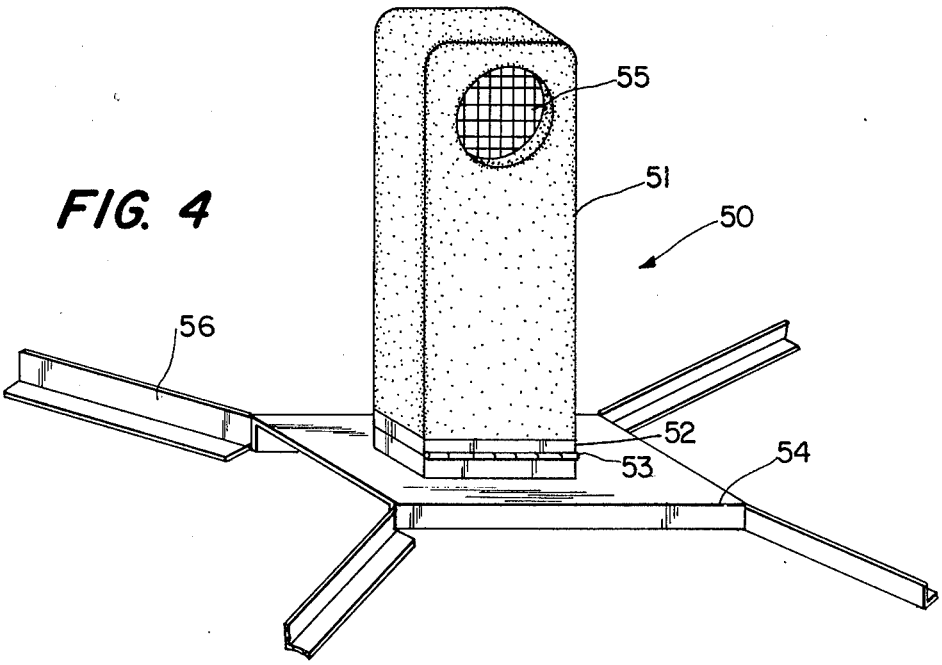
FIG. 4 is a perspective view wherein the single column barrier has a column attached by a spring-loaded hinge to the base.

In FIG. 4, a barrier indicated generally at 50 has a vinyl column 51 attached to a sub-base 52 which in turn is pivotally connected by a spring-loaded hinge 53 to a base 54. The column 51 may also be of the rigid type such as constructed of wood or metal. The column 51 is similarly provided with a light 55 energized by a battery mounted on the base 54. The base is also provided with stabilizing arms 56. The spring-loaded hinge thus enables the column 51 to return to its initial vertical position in the event the column is hit by a vehicle.

While the barrier has been described as comprising hollow sections which are inflated with air or a suitable gas, it is pointed out that these hollow sections may also be filled with a plastic foam material which is resilient in nature or with a granulated foam plastic fill.

The vinyl or flexible portions of the barriers as described above may be provided with red reflective tape applied diagonally substantially as shown in the drawings. Any other suitable high-visibility color tape may also be employed such as black and yellow.

The flashing lighted built-in reflectors may comprise regular lights or merely comprise a reflector without any light. However, some sort of a light or at least a reflector is preferable.

The pylon-type barrier 40 of FIG. 3 is particularly suitable for installation as a permanent type marker or barrier such as might be installed by a municipality to indicate a dangerous situation which is somewhat more than temporary in nature.

Thus it can be seen that the present invention has provided an effective traffic barrier suitable for vehicle or pedestrian traffic which is simple in construction and which will remain in operation even after being hit repeatedly by vehicles. The resilient structure of the barrier will thus not cause any damage to vehicles which might accidentally hit the barriers. The barrier is easily anchored in position and at the same time can be readily removed so as to be repositioned. The inflatable characteristic of the barrier enables the barrier to be readily transported and stored.

It will be understood that this invention is susceptible to modification in order to adapt it to different usages and conditions, and accordingly, it is desired to comprehend such modifications within this invention as may fall within the scope of the appended claims.

What is claimed is:

1. A portable safety traffic barrier comprising a relatively heavy base, a substantially vertical hollow column of a thin flexible material upstanding from said base, a pair of vertically spaced substantially parallel arms of a thin flexible material extending horizontally from said column, a resilient medium filling each of said column and horizontal arms such that said column and arms will return to their vertical and horizontal positions after any impact thereto, means interconnecting the free ends of said horizontal arms, a light on one of said horizontal arms, a source of electrical energy mounted on said base and having electrical leads extending therefrom to connect to said light, and means on said vertical column and said one horizontal arm for securing the said electrical leads thereto.

2. A portable safety traffic barrier as claimed in claim 1 and further comprising means pivotally attached to said base for stabilizing the barrier.

3. A portable safety traffic barrier as claimed in claim 2 wherein said stabilizing means comprises a pair of arms each pivotally attached to said base to pivot horizontally away from each other.

4. A portable safety traffic barrier as claimed in claim 1 wherein said interconnecting means comprises a web.

5. A portable safety traffic barrier as claimed in claim 1 wherein said interconnecting means comprises a second vertical column upstanding from said base.

6. A portable safety traffic barrier as claimed in claim 1 wherein there is at least one opening in said column to decrease wind resistance.

7. A portable safety traffic barrier as claimed in claim 1 wherein said column and said horizontal members are each separate from each other and there is a gaseous medium inflating each of said column and horizontal members.

8. A portable safety traffic barrier as claimed in claim 1 wherein said column and horizontal members are each stuffed with a resilient light-weight foam material.

9. A portable safety traffic barrier as claimed in claim 1 and further comprising detachable fastener means for attaching said column to said base.

10. A portable safety traffic barrier as claimed in claim 1 and further comprising spring-loaded hinge means attaching said column to said base.

* * * * *